US006494388B1

(12) United States Patent
Mueller et al.

(10) Patent No.: US 6,494,388 B1
(45) Date of Patent: Dec. 17, 2002

(54) FUEL INJECTION VALVE

(75) Inventors: Martin Mueller, Möglingen (DE); Ralf Trutschel, Wolfen (DE); Martin Buehner, Backnang (DE); Peter Land, Pettstadt (DE); Helmut Hennemann, Schesslitz (DE); Norbert Keim, Löchgau (DE); Ulrich Klingner, Korntal (DE); Martin Andorfer, Muenchingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/673,945

(22) PCT Filed: Oct. 13, 1999

(86) PCT No.: PCT/DE99/03284

§ 371 (c)(1),
(2), (4) Date: Dec. 22, 2000

(87) PCT Pub. No.: WO00/50765

PCT Pub. Date: Aug. 31, 2000

(30) Foreign Application Priority Data

Feb. 24, 1999 (DE) ..... 199 07 897

(51) Int. Cl.[7] ..... F02M 61/00

(52) U.S. Cl. ..... 239/533.12; 239/533.14; 239/585.1; 239/585.2; 239/585.3; 239/585.5; 239/596

(58) Field of Search ..... 239/533.12, 596, 239/533.14, 533.2, 533.3, 533.9, 533.11, 533.15, 585.1, 585.2, 585.3, 585.4, 585.5

(56) References Cited

U.S. PATENT DOCUMENTS

| | | | | |
|---|---|---|---|---|
| 4,254,915 A | * | 3/1981 | Müller | 239/533.12 |
| 4,467,966 A | * | 8/1984 | Mueller | 239/533.4 |
| 4,650,122 A | | 3/1987 | Knapp et al. | |
| 4,971,254 A | | 11/1990 | Wieczorek et al. | |
| 5,540,200 A | | 7/1996 | Iiyama et al. | |
| 5,875,972 A | * | 3/1999 | Ren et al. | 239/585.4 X |
| 6,019,296 A | * | 1/2000 | Yamamoto et al. | 239/533.2 |
| 6,145,761 A | * | 11/2000 | Muller et al. | 239/533.12 |

FOREIGN PATENT DOCUMENTS

| | | | |
|---|---|---|---|
| DE | 3407545 | * | 9/1985 |
| DE | 197 57 299 | | 6/1998 |
| DE | 19736682 | * | 2/1999 |
| EP | 0 909 920 | | 4/1999 |
| JP | 07 119 584 | | 1/1995 |

* cited by examiner

*Primary Examiner*—Robin O. Evans
(74) *Attorney, Agent, or Firm*—Kenyon & Kenyon

(57) ABSTRACT

A fuel injector, in particular a high-pressure injector for directly injecting fuel into a combustion chamber of a mixture-compression, spark-ignition internal combustion engine, which is characterized in that on a valve seat element a conical section is formed having a valve seat surface, to which an outlet opening is immediately connected on the downstream side. The outlet opening has an intake plane, an outlet plane, and a central axis, the central point of the intake plane being offset with respect to the valve longitudinal axis and the central axis running diagonally with respect to the valve longitudinal axis. Upstream of the valve seat element a disk-shaped swirl element is arranged, which can be used both for generating a right swirl as well as a left swirl.

25 Claims, 7 Drawing Sheets

FUEL INJECTION VALVE

FIELD OF THE INVENTION

The present invention relates to a fuel injector.

BACKGROUND INFORMATION

From German published application No. 197 57 299, a fuel injector is described in which a fuel injection chamber is arranged downstream of a valve seat. For opening and closing the valve, an axially movable valve needle cooperates with the valve seat, the needle having a conical closing segment corresponding to the contour of the valve seat. Upstream of the valve seat, on the exterior periphery of the valve needle, a diagonally running swirl channel is provided. The swirl channel empties into an annular swirl chamber, which is formed between the valve needle and an external valve housing. From this swirl chamber, the fuel is conveyed to the valve seat. From the fuel injection chamber downstream of the valve seat, the fuel flows into an outlet opening, which begins slightly offset from the center of the base surface of the fuel injection chamber and runs downstream diagonally with respect to the valve longitudinal axis.

SUMMARY OF THE INVENTION

The fuel injector according to the present invention has the advantage that it can be manufactured cost-effectively in a particularly simple manner. In this context, the injector, especially at its downstream end, can be assembled in a simple and yet very precise manner. Furthermore, using the fuel injector according to the present invention, very good atomization and very precise spray-discharge of the fuel is achieved, e.g., directly into a cylinder of an internal combustion engine. A particularly uniform front of the spray-discharged spray is attained. In addition, individual streams in the spray of great speed and depth of penetration are avoided.

In a particularly advantageous manner, swirling fuel is fed to the valve seat in the valve seat element over an extremely short flow route. This very short flow route is also guaranteed to the extent that the outlet opening begins immediately at the end of the valve seat surface, avoiding any collector spaces.

The disk-shaped swirl element according to the present invention has a very simple structure and can therefore be shaped in a simple manner. It is the task of the swirl element to generate a swirl or rotary motion in the fuel. Since the swirl element is an individual structural element, its handling in the manufacturing process should not give rise to any limitations.

Ideally, the same disk-shaped swirl element can be used both for a left swirl as well as for a right swirl. By installing the swirl element so that either the front side or the back side is facing the valve seat, this variation can be accomplished extremely simply.

In comparison to swirl bodies that have grooves or similar swirl-producing indentations on an end face, it is possible to create an interior outlet opening area in the swirl element using the simplest of means, the opening area extending over the entire axial thickness of the swirl element and being surrounded by an exterior circumferential edge area.

To guarantee a clear-cut installation position of the swirl element and to avoid mixing up the right swirl and the left swirl, or to design a locking element in the swirl element, installation aids are advantageously pre-molded on the exterior periphery of the swirl element.

By configuring a guide element, which functions to guide the valve needle, as having alternately areas protruding in tooth-like fashion and recesses in between on the exterior periphery, the possibility is created in a simple manner to guarantee an optimal flow into the swirl channels of the swirl element located underneath.

The modular assembly of the guide, swirl, and valve seat elements, as well as the separation of function associated with it, has the advantage that the individual components can be shaped in a very flexible manner, so that through a simple variation of one element, different injecting sprays (spray angle, static injection quantities) can be generated.

The fuel injector according to the present invention in addition to the advantages already mentioned, has the advantage that due to the "skewed" arrangement of the outlet opening, swirling, extremely finely atomized fuel sprays can be spray-discharged, in a completely controlled manner, into particularly desirable edge areas, e.g., of a cylinder, without having to abandon, e.g., a desirable hollow cone distribution.

The fuel injector according to the present invention has the advantage that particularly desirable special jet shapes of the spray-discharged fuel can be attained in a simple manner. These are particularly desirable when the internal combustion engine is subject to certain difficult installation conditions or when diagonal but not rotationally symmetrical fuel sprays, e.g., in direct fuel injection, are to be injected into the cylinder of an internal combustion engine, in a completely controlled manner. In this manner, spray cones deviating from an ideal hollow cone are spray-discharged, the cones having a certain shadow area. On the side of the shadow area, the spray cone can act as if it were cut off, as a result of which it is effectively prevented, for example, that the wall is wetted, which is to be avoided on this side.

Figure 1:
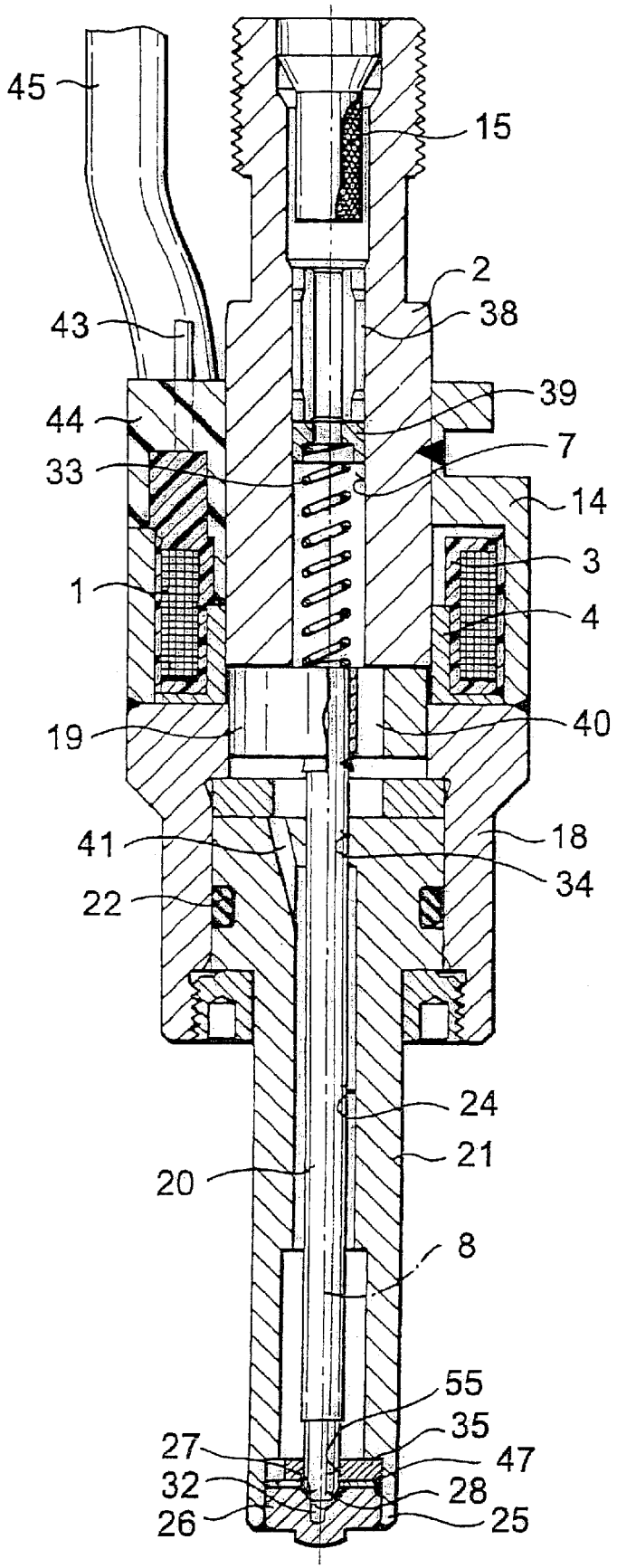
FIG. 1 depicts an exemplary embodiment of a fuel injector.

The electromagnetically actuated valve depicted in FIG. 1, by way of example, as an exemplary embodiment in the form of an injector for fuel injection systems of spark-ignition internal combustion engines, has a tubular, substantially hollow cylindrical core 2, functioning as the internal pole of a magnetic circuit and at least partially surrounded by a solenoid coil 1. The fuel injector is particularly well-suited as a high-pressure injector for the direct injection of fuel into a combustion chamber of an internal combustion engine. A coil shell 3, e.g., stepped, made of plastic, accommodates a winding of solenoid coil 1 and, in connection with core 2 and an annular, non-magnetic intermediate part 4, being partially surrounded by solenoid coil 1 and having an L-shaped cross-section, makes it possible to design the injector in the area of solenoid coil 1 so as to be particularly compact and short.

In core 2, a traversing longitudinal opening 7 is provided, which extends along a valve longitudinal axis 8. Core 2 of the magnetic circuit also functions as a fuel intake support, longitudinal opening 7 representing a fuel supply channel. Fixedly connected to core 2 above solenoid coil 1 is an external metallic (e.g., ferritic) housing part 14, that, as the external pole or the external conductive element, closes the magnetic circuit and completely surrounds solenoid coil 1 at least in the circumferential direction. In longitudinal opening 7 of core 2, a fuel filter 15 is provided on the intake side, which functions to filter out those fuel components which could cause clogging or damage in the injector due to their size. Fuel filter is fixed in core 2, e.g., by pressing-in.

Core 2 along with housing part 14 forms the intake-side end of the fuel injector, upper housing part 14 extending, for example, straight downstream in the axial direction beyond solenoid coil 1. Connected to upper housing part 14 in a sealing and fixed manner is a lower tubular housing part 18, which surrounds and accommodates, for example, an axially movable valve part composed of an armature 19 and a bar-like valve needle 20, or an elongated valve seat support 21. Both housing parts 14 and 18 are fixedly joined to each other, e.g., in a circumferential welded seam.

In the exemplary embodiment depicted in FIG. 1, lower housing part 18 and substantially tubular valve seat support 21 are fixedly joined to each other by a threaded joint; however, welding, soldering, or flanging also represent equally possible jointing methods. The seal between housing part 18 and valve seat support 21 is effected, e.g., using a sealing ring 22. Valve seat support 21 over its entire axial extension has an interior feed-through opening 24 running concentrically with respect to valve longitudinal axis 8.

At its lower end 25, which also represents the downstream termination of the entire fuel injector, valve seat support 21 surrounds a disk-shaped valve seat element 26, pressed-in in feed-through opening 24 and having a valve seat surface 27 that tapers downstream in a truncated cone shape. Arranged in feed-through opening 24 is valve needle 20, for example, being bar-like and having a substantially circular cross section, and having at its downstream end a valve closing segment 28. This valve closing segment 28, which can be shaped in a spherical, partially spherical, or rounded-off manner, or which can taper in a cone- like manner, cooperates in a familiar way with valve seat surface 27 provided in valve seat element 26.

Downstream of valve seat surface 27, in valve seat element 26, an outlet opening 32 is introduced for the fuel. In FIG. 1, this outlet opening 32 is represented only as a blind hole, since the cutaway representation in FIG. 1 is a central cutaway view of the fuel injector, whereas outlet opening 32 has a diagonally inclined extension with respect to valve longitudinal axis 8, as FIG. 2*a* makes clear. Outlet opening 32 in FIG. 1 thus runs either into the plane of the drawing or out from it.

The injector is actuated, in a familiar manner, electromagnetically. A piezo actuator is nevertheless also conceivable as an excitable activating element. Similarly, actuation is conceivable via a piston that is pressure-impacted in a controlled manner. The electromagnetic circuit having solenoid coil 1, core 2, housing parts 14 and 18, and armature 19 functions to bring about the axial movement of valve needle 20 and therefore to open it against the spring force of a re-setting spring 33, arranged in longitudinal opening 7 of core 2, or to close the injector. Armature 19 is connected to the end of valve needle 20 facing away from valve closing segment 28, for example, by a welded seam, and it is aligned with respect to core 2. For guiding valve needle 20 during its axial motion together with armature 19 along valve longitudinal axis 8, there are, on the one hand, a guide opening 34 provided in valve seat support 21 at the end facing armature 19, and, on the other hand, a disk-shaped guide element 35 arranged upstream of valve seat element 26 and having a dimensionally accurate guide opening 55. Armature 19 during its axial motion is surrounded by intermediate part 4.

Arranged between guide element 35 and valve seat element 26 is a further disk-shaped element, specifically a swirl element 47, so that all three elements 35, 47, and 26 are situated directly one on top of the other and are accommodated in valve seat support 21. Three disk-shaped elements 35, 47, and 26 are fixedly joined to each other, for example, in an integral manner.

An adjusting sleeve 38, inserted, pressed-in, or screwed-in in longitudinal opening 7 of core 2, functions to adjust the spring prestressing of re-setting spring 33 in contact on its downstream side with adjusting sleeve 38 via a centering piece 39, the re-setting spring being supported at its opposite side on armature 19. In armature 19, one or a plurality of bore-hole-like flow channels 40 are provided, through which the fuel can arrive in feed-through opening 24 from longitudinal opening 7 in core 2 via connecting channels 41 configured downstream of flow channels 40 in the vicinity of guide opening 34 in valve seat support 21.

The stroke of valve needle 20 is determined by the installation position of valve seat element 26. An end position of valve needle 20, when solenoid coil 1 is not excited, is stipulated by the position of valve closing segment 28 on valve seat surface 27 of valve seat element 26, whereas the other end position of valve needle 20, when solenoid coil 1 is excited, results from the position of armature 19 on the downstream end face of core 2. The surfaces of the components in the aforementioned limit stop area are, for example, chromium-plated.

The electrical contacting of solenoid coil 1, and therefore its excitation, is carried out via contact elements 43, which are provided with a plastic extrusion coat 44 outside coil shell 3. Plastic extrusion coat 44 can also extend over further components (e.g., housing parts 14 and 18) of the fuel injector. An electrical connecting cable 45 runs from plastic extrusion coat 44, making possible the provision of current to solenoid coil 1. Plastic extrusion coat 44 extends through upper housing part 14, which is interrupted in this area.

Figure 2A:
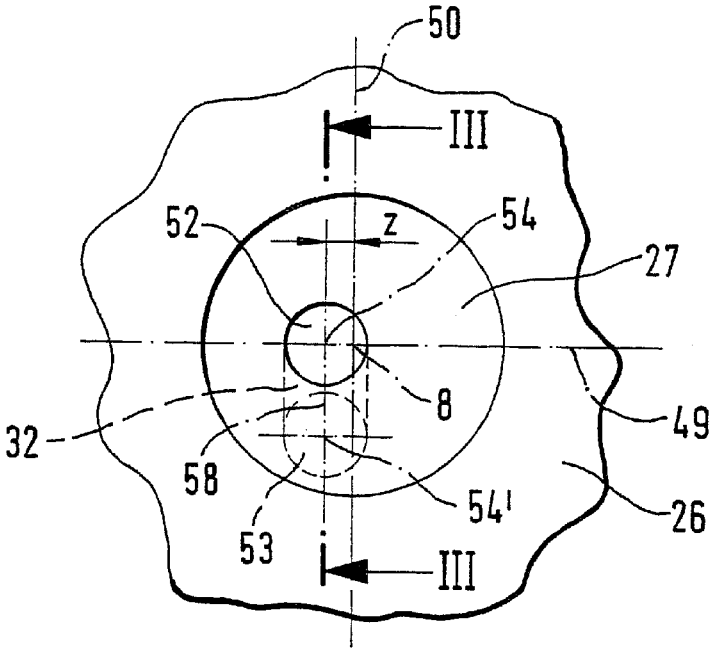
FIG. 2*a* depicts a top view of a central area of a valve seat element for a so-called "right swirl valve" as per the definition.

FIG. 2*a* is a top view of a central area of valve seat element 26 for a so-called "right swirl valve" as per the definition. Within the central area, valve seat surface 27 is configured concentrically with respect to valve longitudinal axis 8, so as to taper in a conical manner in the downstream direction, valve closing segment 28 of valve needle 20 cooperating with the valve seat surface so as to produce a seat valve. For defining the position of outlet opening 32 in valve seat element 26, two axes 49, 50, are declared that are perpendicular to each other, each of which in its direction of extension stretches along imaginary planes, valve longitudinal axis 8 running in the intersection of both axes 49, 50, or of the two imaginary vertical planes. First axis 49 is the axis running horizontally in FIG. 2*a*, and second axis 50 is the axis running vertically in FIG. 2*a*.

Both axes 49, 50, in this context, only run vertically and horizontally in FIG. 2*a* for the purposes of illustration. However, they can also be rotated to any other position in 360°. Only their perpendicular position with respect to each other and their intersection at valve longitudinal axis 8 are decisive.

Figure 4:
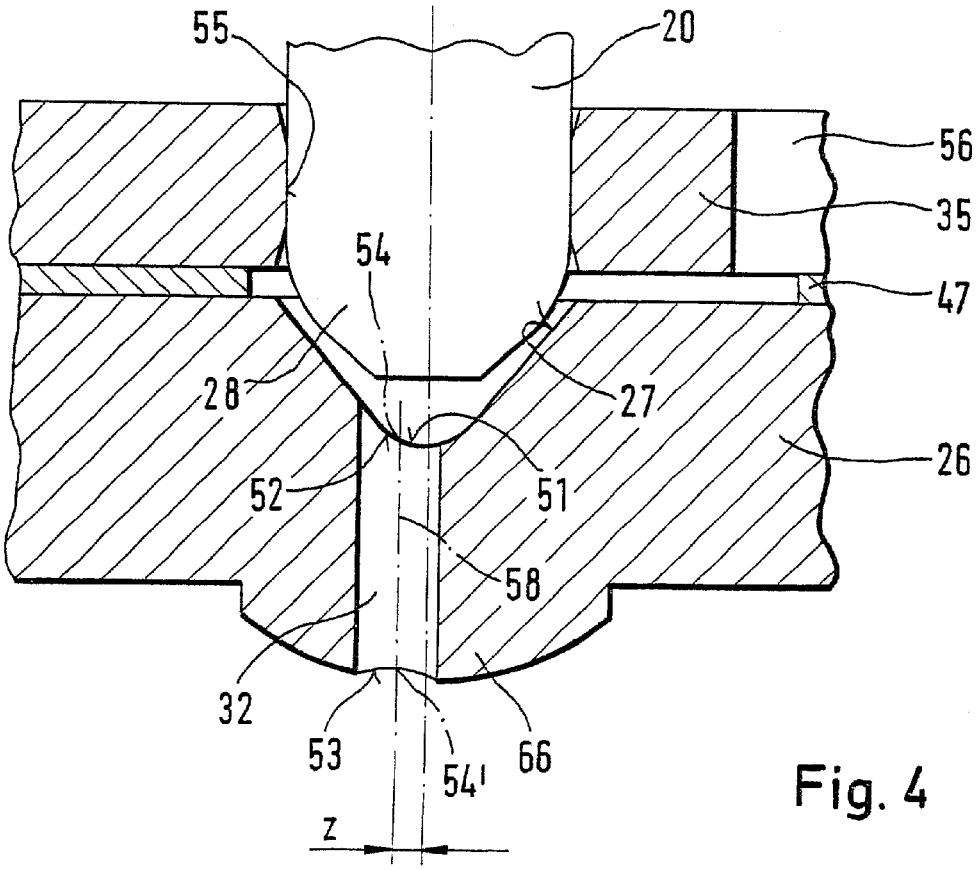
FIG. 4 depicts a cutaway view along the line IV—IV in FIG. 3 as a first exemplary embodiment according to the present invention.
Figure 3:
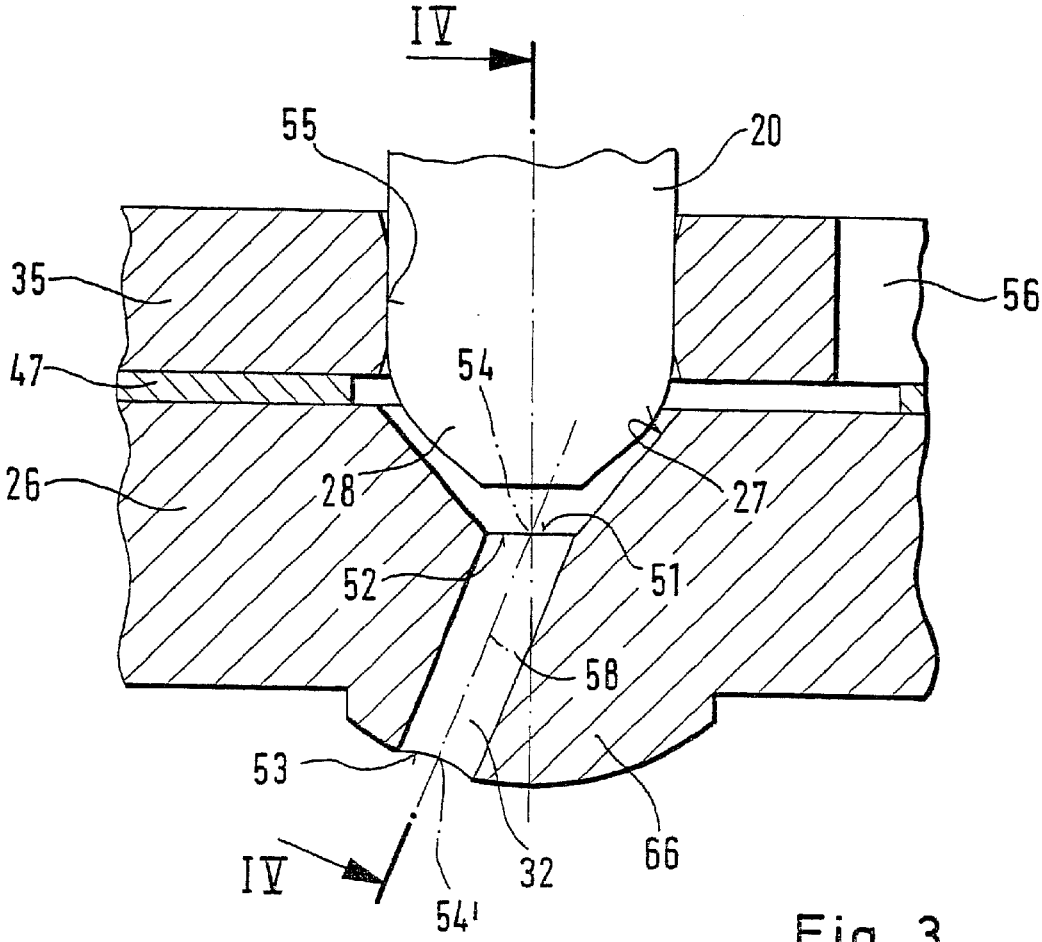
FIG. 3 depicts a cutaway view along the line III—III in FIG. 2*a*.

Valve seat surface 27 forms a conical segment in valve seat element 26, which at its downstream end emerges in a base area 51 (FIGS. 3 and 4) having a small diameter. According to the present invention, the deepest point of base area 51 does not lie on valve longitudinal axis 8, but rather an offset z exists with respect to axis 50, offset with respect to one of axes 49 or 50, in FIG. 2*a*. From the deepest point of base area 51, outlet opening 32 extends in the downstream direction. Intake plane 52 of outlet opening 32 coincides with base area 51 and therefore also has an offset z with respect to axis 50. However, central point 54 of intake plane 52 is located on axis 49. The extension of outlet opening 32 down to its outlet plane 53 is parallel to the imaginary plane extending along axis 50, but not parallel to valve longitudinal axis 8. Rather, outlet opening 32 runs diagonally with respect to valve longitudinal axis 8 in the downstream direction away from it, central point 54' of outlet plane 53, when outlet plane 53 is projected into the plane of intake plane 52, also having the same offset z with respect to axis 50. Briefly, the geometry of outlet opening 32 can be characterized as off-center and diagonal with respect to the axis. FIGS. 3 and 4 illustrate the described geometry representationally. In this context, FIG. 3 depicts a cutaway view along line III—III in FIG. 2*a*, whereas FIG. 4 depicts a cutaway view along line IV—IV in FIG. 3.

FIGS. 2*a*, 3, and 4 illustrate a first exemplary embodiment according to the present invention, in which offset z of central axis 58 of outlet opening 32, on which both central points 54, 54' lie, is smaller with respect to axis 50 than the radius of outlet opening 32. In this context, it can be noticed particularly clearly from FIGS. 2*a* and 4 that the right edge of outlet opening 32, from the point of view of central axis 58, protrudes beyond axis 50, i.e., valve longitudinal axis 8. A further design feature of outlet opening 32 lies in the fact that, when intake plane 52 and outlet plane 53 are projected in one plane, there is no overlapping of both planes 52, 53, as can be seen from FIGS. 2*a* and 3. This is achieved by an appropriate angle of inclination of central axis 58 with respect to valve longitudinal axis 8, as well as by the axial length of outlet opening 32. Outlet opening 32 ends, for example, in a curved, convex spray-discharge area 66. On the basis of an appropriately selected swirl element 47 (FIG. 11), and in combination with valve seat element 26 depicted in FIG. 2*a*, a so-called "right swirl valve" is created.

Figure 2B:
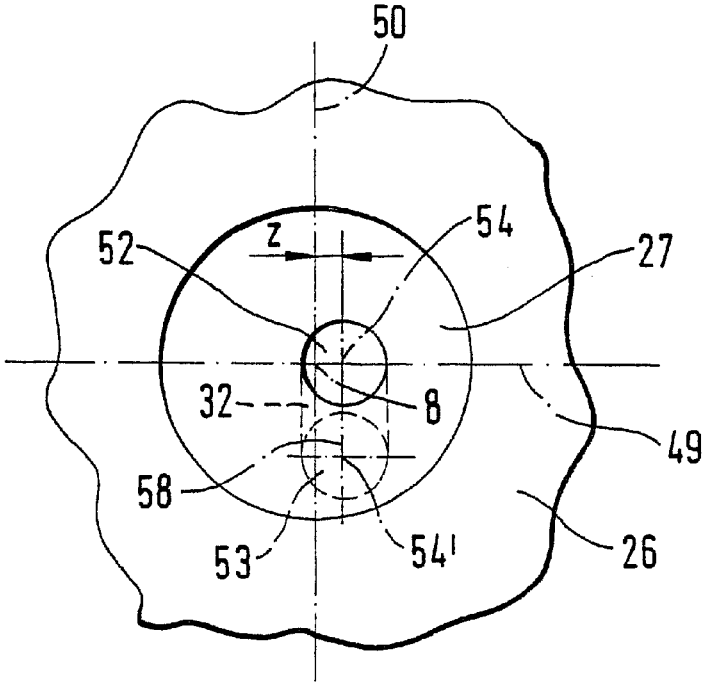
FIG. 2*b* depicts a top view of a central area of a valve seat element for a so-called "left swirl valve" as per the definition.

If outlet opening 32 is introduced in valve seat element 26, reflected about axis 50, as is shown in FIG. 2*b* as a second exemplary embodiment, then a valve seat element 26 is produced that, together with an appropriately configured upstream swirl element 47 (FIG. 10), yields a so-called "left swirl valve."

Figure 2C:
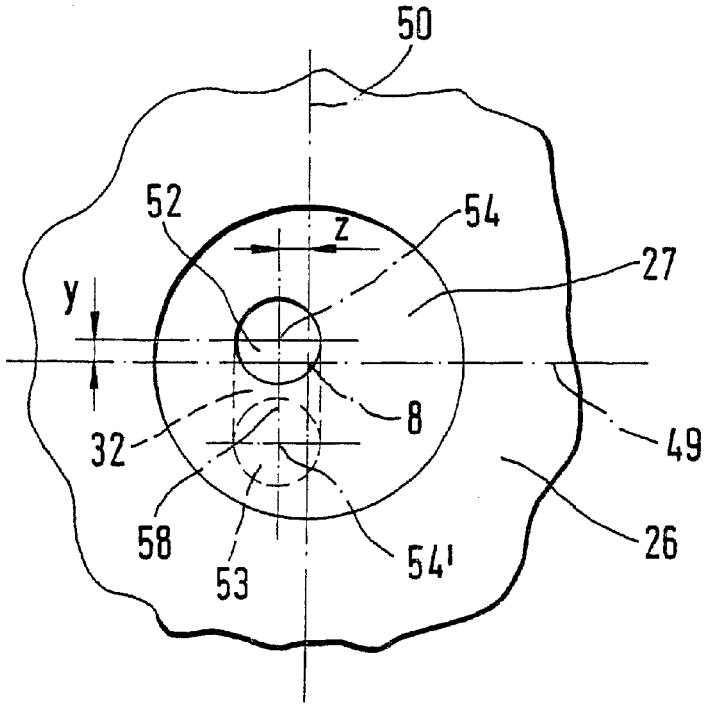
FIG. 2*c* depicts a top view of a central area of a valve seat element having a two-dimensional offset of the outlet opening.

FIG. 2*c* depicts a third exemplary embodiment, which largely corresponds to the one depicted in FIG. 2*a*. However, intake plane 52 of outlet opening 32 is now offset in two dimensions. In addition to offset z with respect to axis 50, in this example, central point 54 of intake plane 52 is also located in front of axis 49 by an amount y. Further undepicted exemplary embodiments can be shaped such that central point 54 of intake plane 52 is situated at various locations on the axis designated as central axis 58. Advantageously, offset y should nevertheless be small on both sides of axis 49, so that intake plane 52, e.g., still has a certain overlapping with axis 49. If, by rotating two axes 49, 50, that are perpendicular with respect to each other, axis 49 is located such that it in turn runs through central point 54 and valve longitudinal axis 8, then it is established that the parallelism of central axis 58 and axis 50 is eliminated. Two-dimensional offset y, z thus has the effect that outlet opening 32 now runs "skewed."

Figure 8:
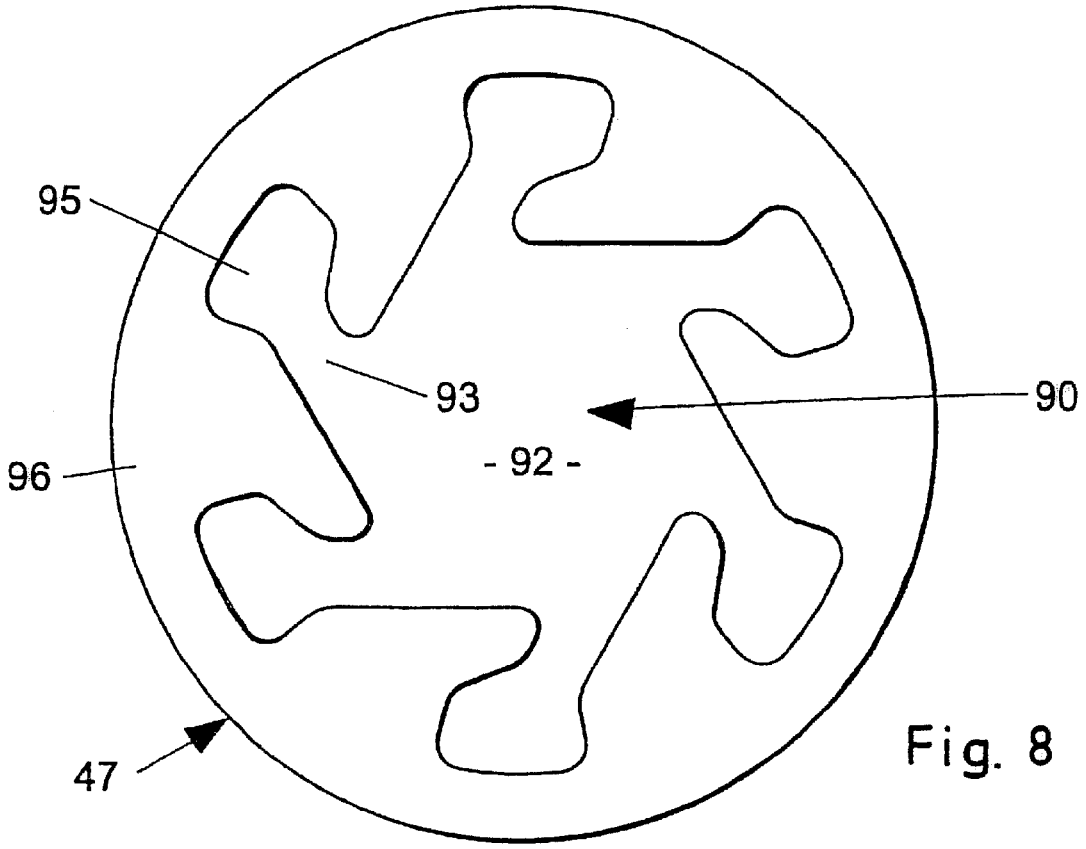
FIG. 8 depicts an exemplary embodiment of a disk-shaped swirl element in a top view

A swirl element 47 arranged upstream of valve seat 27 is described in greater detail on the basis of FIG. 8. In a particularly advantageous manner, swirling fuel is fed to the conical segment having valve seat surface 27 in valve seat element 26 over an extremely short flow route. This very short flow route is also guaranteed to the extent that outlet opening 32 begins immediately at the end of valve seat surface 27 while avoiding any possible collector spaces. Guide element 35 has a dimensionally accurate interior guide opening 55, through which valve needle 20 moves during its axial motion. From the exterior periphery, guide element 35 has, distributed over its circumference, a plurality of recesses 56 (see also FIG. 9), guaranteeing a flow of fuel along the exterior circumference of guide element 35 into swirl element 47 and further in the direction of valve seat surface 27.

Figure 5:
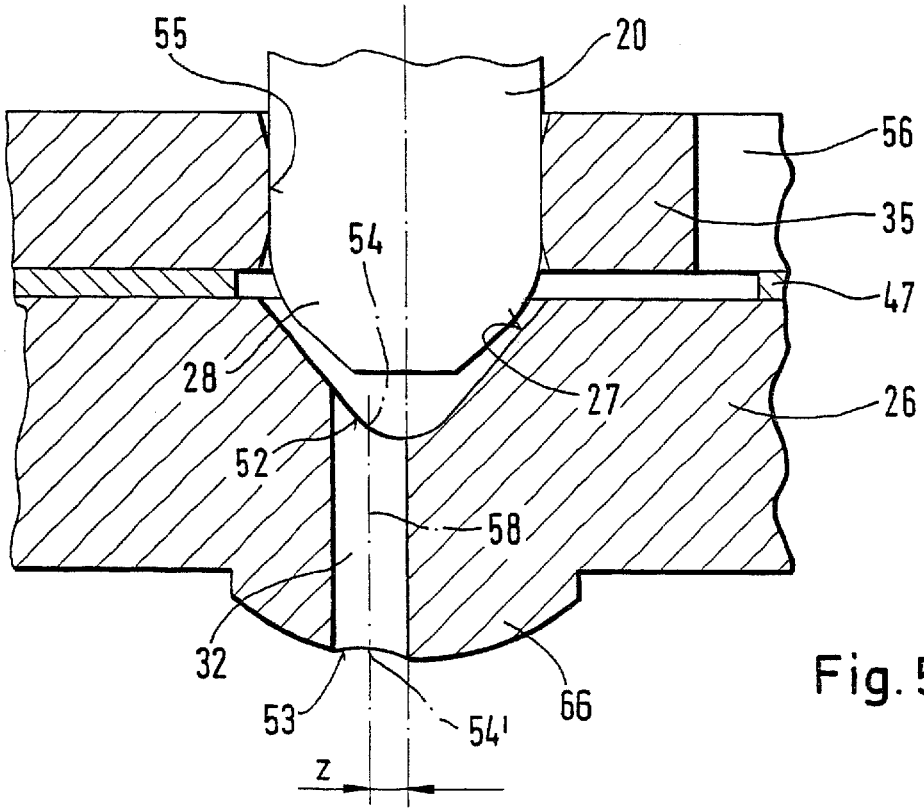
FIG. 5 depicts a fourth exemplary embodiment in a representation by analogy to FIG. 4.
Figure 6:
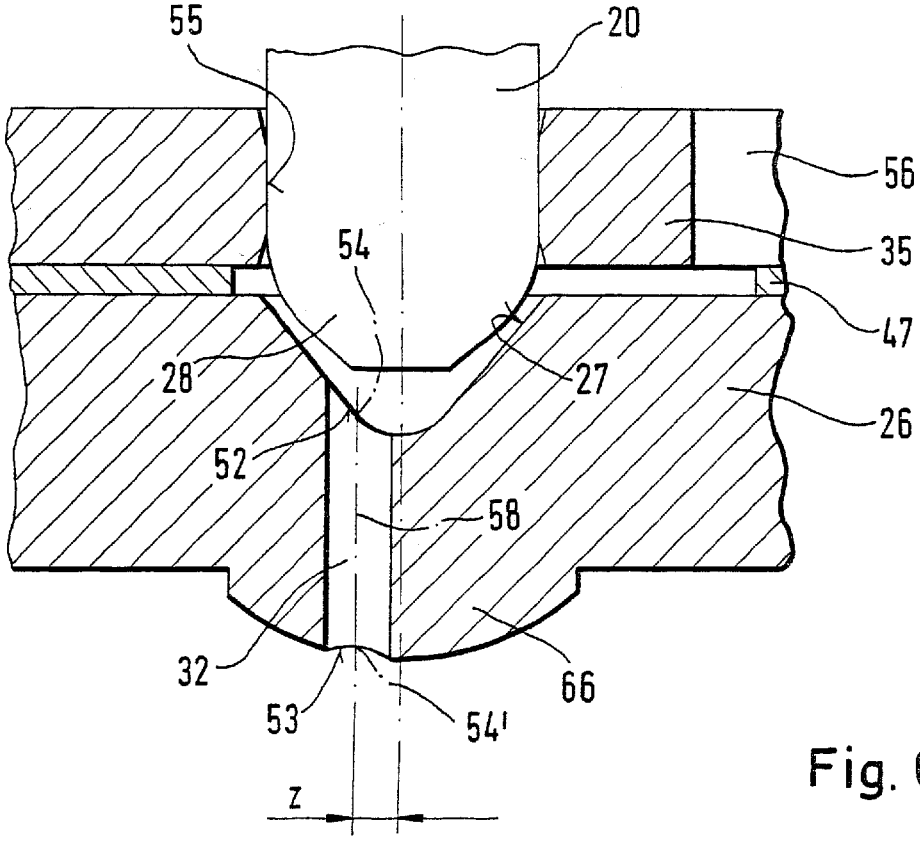
FIG. 6 represents a fifth exemplary embodiment in a representation by analogy to FIG. 4.

In FIGS. 5 and 6, a fourth and fifth exemplary embodiment are depicted in a cutaway view by analogy to FIG. 4. These examples differ only in the size of offset z from the example in FIGS. 2*a*, 3, and 4. In the exemplary embodiment depicted in FIG. 5, offset z of central axis 58 of outlet opening 32, on which both central points 54, 54' lie, is selected with respect to axis 50 so that it is equal to the radius of outlet opening 32. Therefore, the right edge of outlet opening 32 lies on axis 50. In contrast, outlet opening 32 in the example of FIG. 6, is offset so far with respect to axis 50 that offset z is greater than the radius of outlet opening 32.

Figure 7:
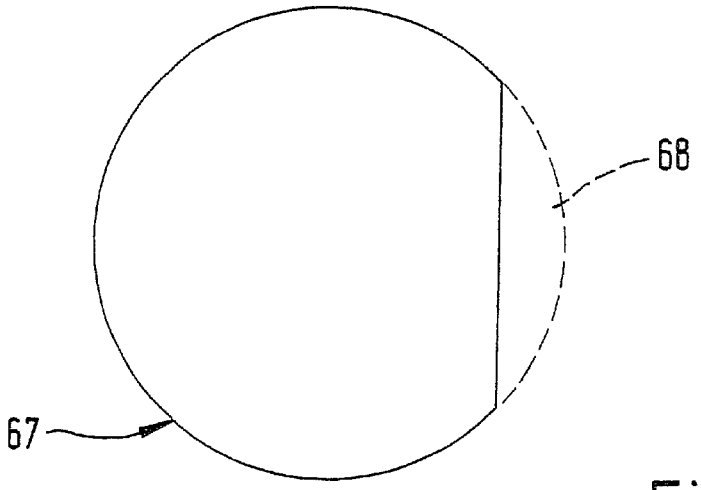
FIG. 7 depicts a simplified symbolic cutaway view of a spray cone that arises in the spray-discharge of fuel from valves according to the exemplary embodiments in FIG. 5 and 6.

In both aforementioned embodiments of outlet opening 32, it is advantageously possible to attain special jet shapes of the spray-discharged fuel. These are particularly desirable when certain difficult installation conditions obtain in the internal combustion engine or when diagonal but not rotationally symmetrical fuel sprays are to be injected into the cylinder of an internal combustion engine in a completely controlled manner, e.g., in direct fuel injection. FIG. 7 depicts an idealized symbolic cutaway view of a spray cone 67, which arises in the spray-discharge of fuel from valves in accordance with the exemplary embodiments in FIGS. 5 and 6, there being a deviation from the rotational symmetry of a cone as a result of a certain shadow area 68. On the side of shadow area 68, spray cone 67 can act as if it were cut off.

In FIG. 8, a swirl element 47, embedded between guide element 35 and valve seat element 26, is depicted as an individual component in a top view. Swirl element 47 can be manufactured from sheet metal in a cost-effective manner, for example, using stamping, wire eroding, laser cutting, etching, or other known methods, or through electroplating deposition. In swirl element 47, an interior opening area 90 is shaped which runs over the entire axial thickness of swirl element 47. Opening area 90 is formed by an interior swirl chamber 92, through which valve closing segment 28 of valve needle 20 extends, and by a multiplicity of swirl channels 93 discharging into swirl chamber 92. Swirl channels 93 discharge tangentially into swirl chamber 92, and their ends 95 facing away from swirl chamber 92 are not in connection with the exterior periphery of swirl element 47. Rather, a circumferential edge area 96 remains between ends 95 of swirl channels 93, configured as intake pockets, and the exterior periphery of swirl element 47.

When valve needle 20 is installed, swirl chamber 92 is bordered to the inside by valve needle 20 (valve closing segment 28) and to the outside by the wall of opening area 90 of swirl element 47. As a result of the tangential discharge of swirl channels 93 into swirl chamber 92, the fuel receives an angular momentum that is maintained in the further flow right up to outlet opening 32. As a result of centrifugal force, the fuel is spray-discharged in a substantially hollow-cone shape. Ends 95 of swirl channels 93 function as collecting pockets, which over a large surface constitute a reservoir for the turbulence-poor flow of the fuel. After the deflection of the flow, the fuel flows slowly and without turbulence into actual tangential swirl channels 93, as a result of which a swirl that is essentially free of disturbance can be generated.

Figure 9:
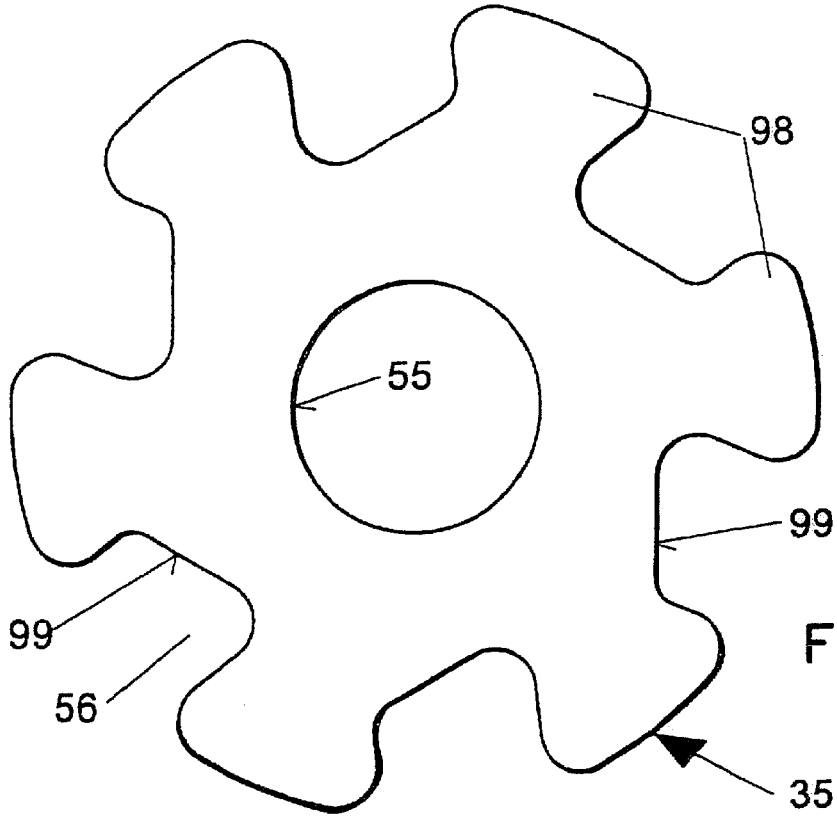
FIG. 9 depicts an exemplary embodiment of a guide element in a top view.

FIG. 9 depicts an exemplary embodiment of guide element 35, which however can also be used in many other exemplary embodiment variants. Over its external periphery, guide element 35 has, in alternating fashion, recesses 56 and areas 98 that protrude in tooth-like fashion. Tooth-like areas 98 can be shaped, e.g., so as to be rounded off. Guide element 35 can be manufactured, e.g., by stamping. In the example according to FIG. 9, the bases of recesses 99 are configured on an incline, so that the bases of recesses 99 advantageously run perpendicular to the axes of swirl channels 93 of swirl element 47, lying underneath.

Figure 10:
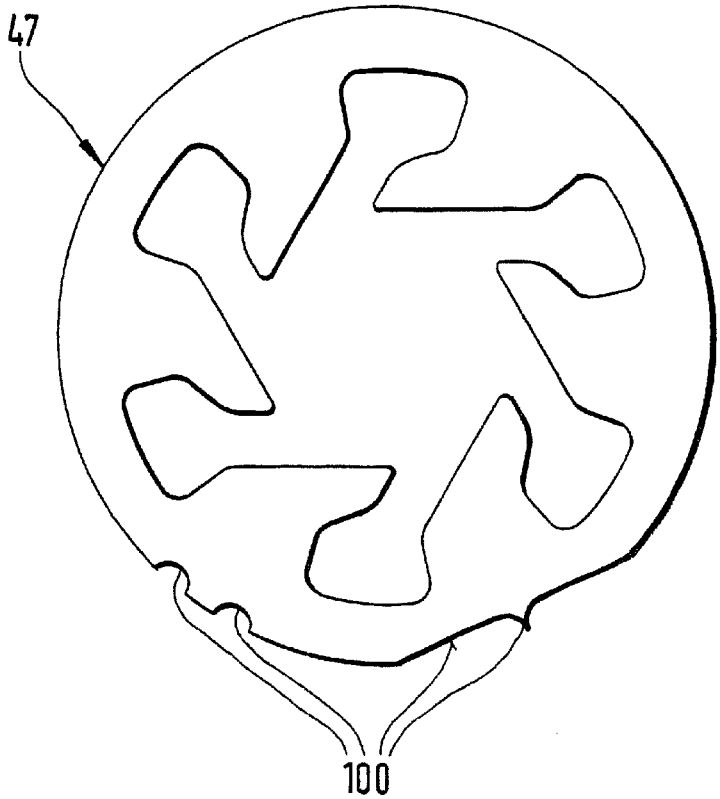
FIG. 10 depicts a second swirl element.
Figure 11:
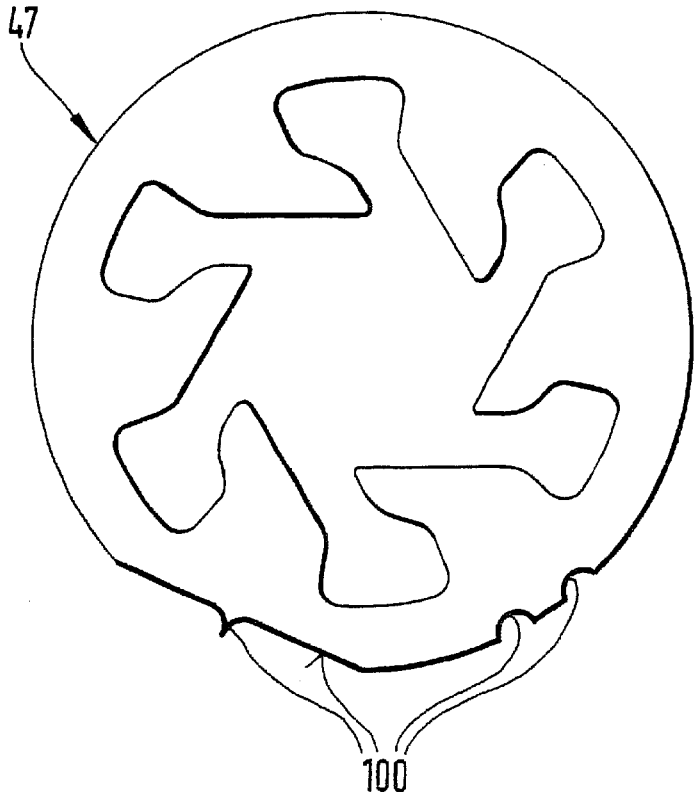
FIG. 11 depicts a third swirl element.

FIGS. 10 and 11 should indicate that it is possible at any time to furnish a fuel injector according to the present invention with a swirl element 47 that generates either a left swirl or a right swirl. Correspondingly, in accordance with the embodiment of swirl element 47, valve seat elements 26 can be varied, using outlet openings 32 that are aimed in varying directions, as is illustrated in FIGS. 2*a* and 2*b*. Ideally, the same disk-shaped swirl element 47 can be used both for a left swirl as well as for a right swirl. As FIGS. 10 and 11 show, swirl element 47 according to FIG. 11 is only the mirror image of swirl element 47 according to FIG. 10, i.e., laid on its back side. To guarantee a clear-cut installation position of swirl element 47 and to avoid any confusion between right swirl and left swirl, i.e., to design a locking element of swirl element 47, installation aids 100 are preformed on the exterior periphery of swirl element 47. These installation aids 100 can have the shape of notches, grooves, or other indentations, of flattened-off areas, or even of projecting studs or other protuberances.

What is claimed is:

1. A fuel injector for a fuel injection system of an internal combustion engine, comprising:

an excitable activation element;

a valve seat element including an outlet opening that includes:

an intake plane, an outlet plane, and a central axis;

a fixed valve seat arranged on the valve seat element, the outlet opening being arranged downstream of the fixed valve seat;

a valve needle arranged with respect to the excitable activation element and being moveable axially along a valve longitudinal axis, the valve needle including a downstream end that includes a valve closing segment, the valve closing segment cooperating with the fixed valve seat for opening and closing a valve; and a disk-shaped swirl element arranged upstream of the fixed valve seat, wherein:

a central point of the intake plane is offset with respect to the valve longitudinal axis, the central point of the intake plane and the valve longitudinal axis defining an offset plane, and the central axis and the the valve longitudinal axis define an outlet-opening plane, the outlet-opening plane being at a non-zero angle with respect to the offset plane.

2. The fuel injector according to claim 1, wherein:

the fuel injector is for a direct injection of a fuel into a combustion chamber,of the internal combustion engine.

3. The fuel injector according to claim 1, wherein:

the disk-shaped swirl element is located immediately upstream of the valve seat element and abuts against the valve seat element.

4. The fuel injector according to claim 1, wherein:

the disk-shaped swirl element includes a right swirl and a left swirl.

5. The fuel injector according to claim 1, wherein:

the disk-shaped swirl element includes an interior opening area having a plurality of swirl channels, the interior opening area extends completely over an entire axial thickness of the disk-shaped swirl element, and the plurality of swirl channels are not connected via a circumferential edge area to an exterior periphery of the disk-shaped swirl element.

6. The fuel injector according to claim 5, wherein:

the interior opening area of the disk-shaped swirl element is formed by a stamping operation.

7. The fuel injector according to claim 5, wherein:

the interior opening area is formed by an interior swirl chamber and by a multiplicity of the plurality of swirl channels discharging into a swirl chamber.

8. The fuel injector according to claim 7, wherein:

the plurality of swirl channels include ends located away from the swirl chamber, and the ends, as intake pockets, include a larger cross-section than remaining portions of the plurality of swirl channels.

9. The fuel injector according to claim 1, wherein:

the disk-shaped swirl element includes on an external periphery installation aids that assist in a clear characterization of an installation position of the disk-shaped swirl element.

10. The fuel injector according to claim 1, wherein:

a first imaginary horizontal axis runs through the central point of the intake plane of the outlet opening, a second imaginary horizontal axis runs perpendicular to the first imaginary horizontal axis, the valve longitudinal axis runs in an intersection of the first imaginary horizontal axis and the second imaginary horizontal axis, and a central point of the outlet plane of the outlet opening, when projected into a plane of the intake plane, includes a first offset with respect to the second imaginary horizontal axis that is the same as a second offset of the central point,of the intake plane with respect to the second imaginary horizontal axis.

11. The fuel injector according to claim 1, wherein:

a first imaginary horizontal axis runs through the central point of the intake plane of the outlet opening, a second imaginary horizontal axis runs perpendicular to the first imaginary horizontal axis, the valve longitudinal axis runs in an intersection of the first imaginary horizontal axis and the second imaginary horizontal axis, and a central point of the outlet plane of the outlet opening, when projected into a plane of the intake plane, includes a first offset with respect to the second imaginary horizontal axis that is different than a second offset of the central point of the intake plane with respect to the second imaginary horizontal axis.

12. The fuel injector according to claim 10,wherein:

when the intake plane and the outlet plane are projected in one plane, no overlap of the intake plane and the outlet plane occurs.

13. The fuel injector according to claim 11, wherein:

when the intake plane and the outlet plane are projected in one plane, no overlap of the intake plane and the outlet plane occurs.

14. The fuel injector according to claim 1, wherein:

the fixed valve seat forms a conical section in the valve seat element, and a downstream end of the conical section emerges in a base area that immediately forms the intake plane of the outlet opening.

15. A fuel injector for a fuel injection system of an internal combustion engine, comprising:

an excitable activation element;

a valve seat element including an outlet opening that includes:

an intake plane, an outlet plane, and a central axis;

a fixed valve seat arranged on the valve seat element, the outlet opening being located downstream of the fixed valve seat;

a valve needle arranged with respect to the excitable activation element and being moveable axially along a valve longitudinal axis, a downstream end of the valve needle including a valve closing segment, the valve closing segment cooperating with the fixed valve seat for opening and closing the valve; and a swirl element arranged upstream of the fixed valve seat, wherein:

a central point of the intake plane is offset with respect to the valve longitudinal axis, the central axis runs diagonally with respect to the valve longitudinal axis, a first imaginary horizontal axis runs through the central point of the intake plane of the outlet opening, a second imaginary horizontal axis runs perpendicular to the first imaginary horizontal axis, the valve longitudinal axis runs in an intersection of the first imaginary horizontal axis and the second imaginary horizontal axis, and the outlet opening is arranged such that a central point of the outlet plane of the outlet opening, when projected into a plane of the intake plane, includes a first offset with respect to the second imaginary horizontal axis that is different than a second offset of the central point of the intake plane with respect to the second imaginary horizontal axis.

16. The fuel injector according to claim 15, wherein:

the fuel injector is for a direct injection of a fuel into a combustion chamber of the internal combustion engine.

17. The fuel injector according to claim 15 wherein:

the swirl element includes a disk-shaped swirl element.

18. The fuel injector according to claim 15, wherein:

when the intake plane and the outlet plane are projected in a plane, no overlap of the intake plane and the outlet plane occurs.

19. The fuel injector according to claim 15, wherein:

the fixed valve seat forms a conical section in the valve seat element, and a downstream end of the conical section emerges in a base area that immediately forms the intake plane of the oulet opening.

20. A fuel injector for a fuel injection system of an internal combustion engine, comprising:

an excitable activation element;

a valve seat element including an outlet opening that includes:

an intake plane, an outlet plane, and a central axis;

a fixed valve seat arranged on the valve seat element, the outlet opening being located downstream of the fixed valve seat;

a valve needle arranged with respect to the excitable activation element and being moveable axially along a valve longitudinal axis, a downstream end of the valve needle including a valve closing segment, the valve closing segment cooperating with the fixed valve seat for opening and closing the valve; and a swirl element arranged upstream of the fixed valve seat, wherein:

a central point of the intake plane is offset with respect to the valve longitudinal axis, the central point of the intake plane and the valve longitudinal axis defining an offset plane, the central axis and the the valve longitudinal axis define an outlet-opening plane, the outlet-opening plane being at a non-zero angle with respect to the offset plane, a first imaginary horizontal axis runs through the central point of the intake plane of the outlet opening, a second imaginary horizontal axis runs perpendicular to the first imaginary horizontal axis, the valve longitudinal axis runs in an intersection of the first imaginary horizontal axis and the second imaginary horizontal axis, and the outlet opening is arranged such that there is no point of intersection between the intake plane of the outlet opening and the second imaginary horizontal axis.

21. The fuel injector according to claim 20 wherein:

the fuel injector is for a direct injection of a fuel into a combustion chamber of the internal combustion engine.

22. The fuel injector according to claim 20, wherein:

the swirl element includes a disk-shaped swirl element.

23. The fuel injector according to claim 20, wherein:

when the intake plane and the outlet plane are projected in a plane, no overlap of the intake plane and the outlet plane occurs.

24. The fuel injector according to claim 20, wherein:

the fixed valve seat forms a conical section in the valve seat element, and a downstream end of the conical section emerges in a base area that immediately forms the intake plane of the outlet opening.

25. The fuel injector according to claim 20, wherein:

a central point of the outlet plane of the outlet opening, when projected into a plane of the intake plane, includes a first offset with respect to the second imaginary horizontal axis that is the same as a second offset of the central point of the intake plane with respect to the second imaginary horizontal axis.

* * * * *